United States Patent [19]

Ernsthausen

[11] 3,976,823

[45] Aug. 24, 1976

[54] STRESS-BALANCED COATING COMPOSITE FOR DIELECTRIC SURFACE OF GAS DISCHARGE DEVICE

[75] Inventor: Roger E. Ernsthausen, Luckey, Ohio

[73] Assignee: Owens-Illinois, Inc., Toledo, Ohio

[22] Filed: Sept. 21, 1973

[21] Appl. No.: 399,747

Related U.S. Application Data

[63] Continuation-in-part of Ser. No. 70,523, Sept. 8, 1970, abandoned, and a continuation-in-part of Ser. No. 163,066, July 15, 1971, abandoned.

[52] U.S. Cl. ..... 428/539; 313/201; 313/213; 313/214; 313/217; 428/426; 428/428; 428/432

[51] Int. Cl.[2] ..... H01J 61/30; H01J 65/04

[58] Field of Search ..... 117/215, 219, 221, 223, 117/217, 69; 313/201, 204, 210, 213, 214, 217, 218, 182, 188; 315/169 TV; 428/428, 432, 426, 411, 539

[56] References Cited

UNITED STATES PATENTS

| | | | |
|---|---|---|---|
| 2,708,726 | 5/1955 | Atherton | 117/219 |
| 3,496,011 | 2/1970 | Crosby et al. | 117/69 |
| 3,499,167 | 3/1970 | Baker et al. | 313/188 |
| 3,634,719 | 1/1972 | Ernsthausen | 313/218 |
| 3,716,742 | 2/1973 | Nakayama | 313/188 |

*Primary Examiner*—Cameron K. Weiffenbach
*Attorney, Agent, or Firm*—Donald Keith Wedding

[57] ABSTRACT

There is disclosed a multiple gaseous discharge display memory panel having an electrical memory and capable of producing a visual display, the panel being characterized by an ionizable gaseous medium in a gas chamber formed by a pair of opposed dielectric material charge storage members, each of which is respectively backed by an array of electrodes, the electrodes behind each dielectric material member being appropriately oriented with respect to the electrodes behind the opposing dielectric material member so as to define a plurality of discrete discharge volumes constituting a discharge unit.

The surface of each dielectric material charge storage member contains a first layer of at least one compound of Group IIA, Al, Si, Ti, Zr, Hf, or mixtures thereof; a second layer of at least one compound of Group IIA, Al, Si, Ti, Zr, Hf, or mixtures thereof which is chemically different from the first layer; and a third layer of an electron-emissive material; the combination of the first and second layers being sufficient to prevent ion migration from the dielectric to the third layer and sufficient to provide a thermally and structurally stable base for the third layer; and the second layer being chemically inert relative to the third layer.

12 Claims, 5 Drawing Figures

STRESS-BALANCED COATING COMPOSITE FOR DIELECTRIC SURFACE OF GAS DISCHARGE DEVICE

RELATED APPLICATIONS

This is a continuation-in-part of copending U.S. patent application Ser. No. 70,523, filed Sept. 8, 1970, now abandoned, and a continuation-in-part of copending U.S. patent application Ser. No. 163,066, filed July 15, 1971 now abandoned.

BACKGROUND OF THE INVENTION

This invention relates to novel multiple gas discharge display/memory panels or units which have an electrical memory and which are capable of producing a visual display or representation of data such as numerals, letters, television display, radar displays, binary words, etc.

Multiple gas discharge display and/or memory panels of one particular type with which the present invention is concerned are characterized by an ionizable gaseous medium, usually a mixture of at least two gases at an appropriate gas pressure, in a thin gas chamber or space between a pair of opposed dielectric charge storage members which are backed by conductor (electrode) members, the conductor members backing each dielectric member typically being appropriately oriented so as to define a plurality of discrete gas discharge units or cells.

In some prior art panels the discharge cells are additionally defined by surrounding or confining physical structure such as apertures in perforated glass plates and the like so as to be physically isolated relative to other cells. In either case, with or without the confining physical structure, charges (electrons, ions) produced upon ionization of the elemental gas volume of a selected discharge cell, when proper alternating operating potentials are applied to selected conductors thereof, are collected upon the surfaces of the dielectric at specifically defined locations and constitute an electrical field opposing the electrical field which created them so as to terminate the discharge for the remainder of the half cycle and aid in the initiation of a discharge on a succeeding opposite half cycle of applied voltage, such charges as are stored constituting an electrical memory.

Thus, the dielectric layers prevent the passage of substantial conductive current from the conductor members to the gaseous medium and also serve as collecting surfaces for ionized gaseous medium charges (electrons, ions) during the alternate half cycles of the A.C. operating potentials, such charges collecting first on one element or discrete dielectric surface area and then on an opposing element or discrete dielectric surface area on alternate half cycles to constitute an electrical memory.

An example of a panel structure containing non-physically isolated or open discharge cells is disclosed in U.S. Pat. No. 3,499,167 issued to Theodore C. Baker, et al.

An example of a panel containing physically isolated cells is disclosed in the article by D. L. Bitzer and H. G. Slottow entitled "The Plasma Display Panel — A Digitally Addressable Display With Inherent Memory", Proceeding of the Fall Joint Computer Conference, IEEE, San Francisco, California, Nov. 1966, pages 541–547. Also reference is made to U.S. Pat. No. 3,559,190.

In the construction of the panel, a continuous volume of ionizable gas is confined between a pair of dielectric surfaces backed by conductor arrays typically forming matrix elements. The cross conductor arrays may be orthogonally related (but any other configuration of conductor arrays may be used) to define a plurality of opposed pairs of charge storage areas on the surfaces of the dielectric bounding or confining the gas. Thus, for a conductor matrix having H rows and C columns the number of elemental or discrete areas will be twice the number of such elemental discharge cells.

In addition, the panel may comprise a so-called monolithic structure in which the conductor arrays are created on a single substrate and wherein two or more arrays are separated from each other and from the gaseous medium by at least one insulating member. In such a device the gas discharge takes place not between two opposing electrodes, but between two contiguous or adjacent electrodes on the same substrate; the gas being confined between the substrate and an outer retaining wall.

It is also feasible to have a gas discharge device wherein some of the conductive or electrode members are in direct contact with the gaseous medium and the remaining electrode members are appropriately insulated from such gas, i.e., at least one insulated electrode.

In addition to the matrix configuration, the conductor arrays may be shaped otherwise. Accordingly, while the preferred conductor arrangement is of the crossed grid type as discussed herein, it is likewise apparent that where a maximal variety of two dimensional display patterns is not necessary, as where specific standardized visual shapes (e.g., numerals, letters, words, etc.) are to be formed and image resolution is not critical, the conductors may be shaped accordingly, i.e., a segmented display.

The gas is one which produces a visible light or invisible radiation which stimulates a phosphor (if visual display is an objective) and a copious supply of charges (ions and electrons) during discharge.

In the prior art, a wide variety of gases and gas mixtures have been utilized as the gaseous medium in a number of different gas discharge devices. Typical of such gases include pure gases and mixtures of Co; $CO_2$; halogens; nitrogen; $NH_3$; oxygen, water vapor; hydrogen; hydrocarbons; $P_2O_5$; boron fluoride, acid fumes; $TiCl_4$; air; $H_2O_2$; vapors of sodium, mercury, thallium, cadmium, rubidium, and cesium; carbon disulfide, laughing gas; $H_2S$; deoxygenated air; phosphorus vapors; $C_2H_2$; $CH_4$; naphthalene vapor; anthracene; freon, ethyl alcohol; methylene bromide; heavy hydrogen; electron attaching gases; sulfur hexafluoride; tritium; radioactive gases; and the so-called rare or inert Group VIII gases.

In an open cell Baker, et al. type panel, the gas pressure and the electric field are sufficient to laterally confine charges generated on discharge within elemental or discrete dielectric areas within the perimeter of such areas, especially in a panel containing non-isolated discharge cells. As described in the Baker, et al. patent, the space between the dielectric surfaces occupied by the gas is such as to permit photons generated on discharge in a selected discrete or elemental volume of gas to pass freely through the gas space and strike surface areas of dielectric remote from the selected discrete volumes, such remote, photon struck dielectric surface areas thereby emitting electrons so as to condition at least one elemental volume other than the elemental volume in which the photons originated.

With respect to the memory function of a given discharge panel, the allowable distance or spacing between the dielectric surfaces depends, inter alia, on the frequency of the alternating current supply, the distance typically being greater for lower frequencies.

While the prior art does disclose gaseous discharge devices having externally positioned electrodes for initiating a gaseous discharge, sometimes called "electrodeless discharge", such prior art devices utilized frequencies and spacing or discharge volumes and operating pressures such that although discharges are initiated in the gaseous medium, such discharges are ineffective or not utilized for charge generation and storage at higher frequencies; although charge storage may be realized at lower frequencies, such charge storage has not been utilized in a display/memory device in the manner of the Bitzer-Slottow or Baker, et al. invention.

The term "memory margin" is defined herein as $$M.\ M. = \frac{V_f - V_E}{V_f/2}$$

where $V_f$ is the half amplitude of the smallest sustaining voltage signal which results in a discharge every half cycle, but at which the cell is not bi-stable and $V_E$ is the half amplitude of the minimum applied voltage sufficient to sustain discharges once initiated.

It will be understood that the basic electrical phenomenon utilized in this invention is the generation of charges (ions and electrons) alternately storable at pairs of opposed or facing discrete points or areas on a pair of dielectric surfaces backed by conductors connected to a source of operating potential. Such stored charges result in an electrical field opposing the field produced by the applied potential that created them and hence operate to terminate ionization in the elemental gas volume between opposed or facing discrete points or areas of dielectric surface. The term "sustain a discharge" means producing a sequence of momentary discharges, at least one discharge for each half cycle of applied alternating sustaining voltage, once the elemental gas volume has been fired, to maintain alternate storing of charges at pairs of opposed discrete areas on the dielectric surfaces.

As used herein, a cell is in the "on state" when a quantity of charge is stored in the cell such that on each half cycle of the sustaining voltage, a gaseous discharge is produced.

In addition to the sustaining voltage, other voltages may be utilized to operate the panel, such as firing, addressing, and writing voltages.

A "firing voltage" is any voltage, regardless of source, required to discharge a cell. Such voltage may be completely external in origin or may be comprised of internal cell wall voltage in combination with externally originated voltages.

An "addressing voltage" is a voltage produced on the panel X - Y electrode coordinates such that at the selected cell or cells, the total voltage applied across the cell is equal to or greater than the firing voltage whereby the cell is discharged.

A "writing voltage" is an addressing voltage of sufficient magnitude to make it probable that on subsequent sustaining voltage half cycles, the cell will be in the on state.

In the operation of a multiple gaseous discharge device, of the type described hereinbefore, it is necessary to condition the discrete elemental gas volume of each discharge cell by supplying at least one free electron thereto such that a gaseous discharge can be initiated when the cell is addressed with an appropriate voltage signal.

The prior art has disclosed and practiced various means for conditioning gaseous discharge cells.

One such means of panel conditioning comprises a so-called electronic process whereby an electronic conditioning signal or pulse is periodically applied to all of the panel discharge cells, as disclosed for example in British patent specification No. 1,161,832, page 8, lines 56 to 76. Reference is also made to U.S. Pat. No. 3,559,190 and "The Device Characteristics of the Plasma Display Element" by Johnson, et al., IEEE Transactions On Electron Devices, September, 1971. However, electronic conditioning is self-conditioning and is only effective after a discharge cell has been previously conditioned; that is, electronic conditioning involves periodically discharging a cell and is therefore a way of maintaining a presence of free electrons. Accordingly, one cannot wait too long between the periodically applied conditioning pulses since there must be at least one free electron present in order to discharge and condition a cell.

Another conditioning method comprises the use of external radiation, such as flooding part or all of the gaseous medium of the panel with ultraviolet radiation. This external conditioning method has the obvious disadvantage that it is not always convenient or possible to provide external radiation to a panel, especially if the panel is in a remote position. Likewise, an external UV source requires auxiliary equipment. Accordingly, the use of internal conditioning is generally preferred.

One internal conditioning means comprises using internal radiation, such as by the inclusion of a radioactive material.

Another means of internal conditioning, which we call photon conditioning, comprises using one or more so-called pilot discharge cells in the on-state for the generation of photons. This is particularly effective in a so-called open cell construction (as described in the Baker, et al. patent) wherein the space between the dielectric surfaces occupied by the gas is such as to permit photons generated on discharge in a selected discrete or elemental volume of gas (discharge cell) to pass freely through the panel gas space so as to condition other and more remote elemental volumes of other discharge units. In addition to or in lieu of the pilot cells, one may use other sources of photons internal to the panel.

Internal photon conditioning may be unreliable when a given discharge unit to be addressed is remote in distance relative to the conditioning source, e.g., the pilot cell. Accordingly, a multiplicity of pilot cells may be required for the conditioning of a panel having a large geometric area. In one highly convenient arrangement, the panel matrix border (perimeter) is comprised of a pluraltiy of such pilot cells.

DRAWINGS ILLUSTRATING GAS DISCHARGE DISPLAY/MEMORY PANEL

Reference is made to the accompanying drawings and the hereinafter discussed FIGS. 1 to 4 shown thereon illustrating a gas discharge display/memory panel of the Baker, et al. type.

Figure 2:
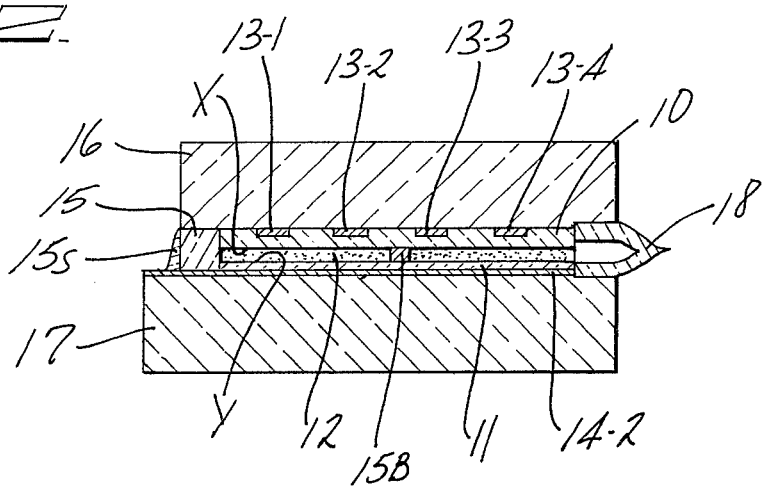
FIG. 2 is a cross-sectional view (enlarged, but not to proportional scale since the thickness of the gas volume, dielectric members and conductor arrays have been enlarged for purposes of illustration) taken on lines 2 — 2 of FIG. 1.
Figure 1:
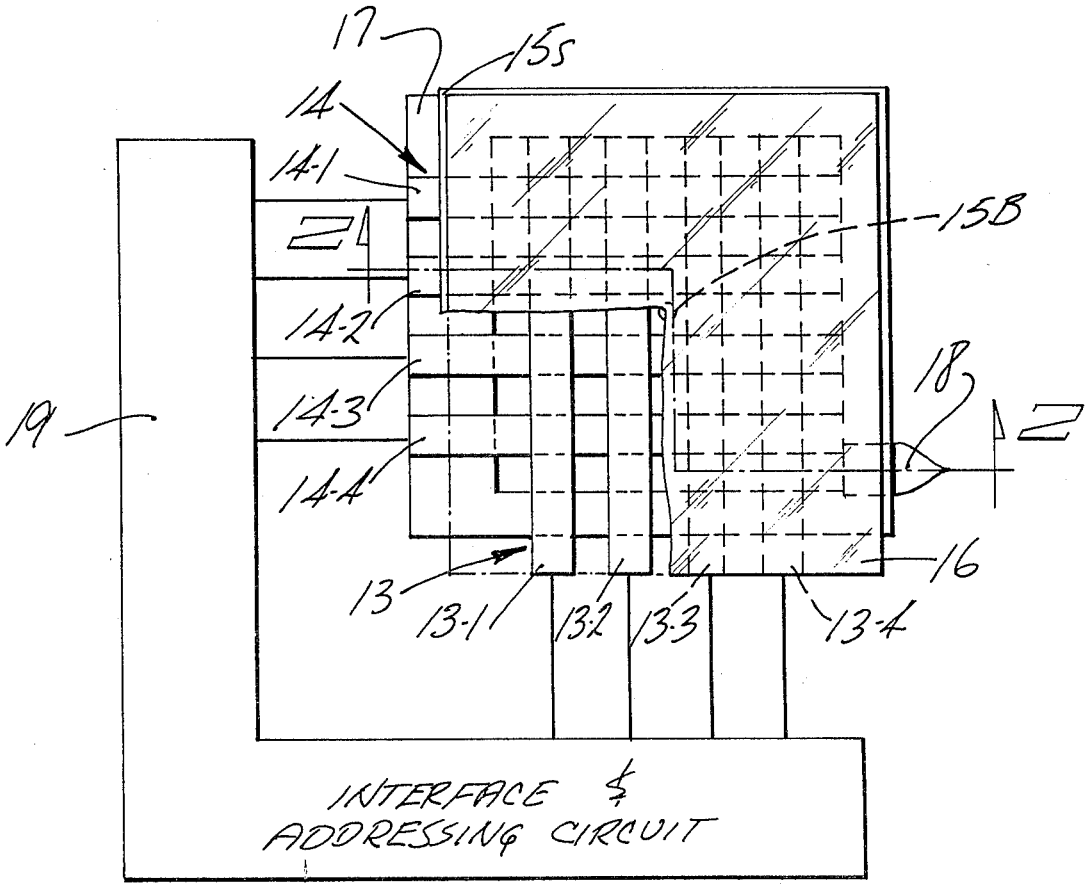
FIG. 1 is a partially cut-away plan view of a gaseous discharge display/memory panel as connected to a diagrammatically illustrated source of operating potentials.

The invention utilizes a pair of dielectric films 10 and 11 separated by a thin layer or volume of a gaseous discharge medium 12, the medium 12 producing a copious supply of charges (ions and electrons) which are alternately collectable on the surfaces of the dielectric members at opposed or facing elemental or discrete areas X and Y defined by the conductor matrix on non-gas-contacting sides of the dielectric members, each dielectric member presenting large open surface areas and a plurality of pairs of elemental X and Y areas. While the electrically operative structural members such as the dielectric members 10 and 11 and conductor matrixes 13 and 14 are all relatively thin (being exaggerated in thickness in the drawings) they are formed on and supported by rigid nonconductive support members 16 and 17 respectively.

Preferably, one or both of nonconductive support members 16 and 17 pass light produced by discharge in the elemental gas volumes. Preferably, they are transparent glass members and these members essentially define the overall thickness and strength of the panel. For example, the thickness of gas layer 12 as determined by spacer 15 is usually under 10 mils and preferably about 4 to 8 mils, dielectric layers 10 and 11 (over the conductors at the elemental or discrete X and Y areas) are usually between 1 and 2 mils thick, and conductors 13 and 14 about 8,000 angstroms thick. However, support members 16 and 17 are much thicker (particularly in larger panels) so as to provide as much ruggedness as may be desired to compensate for stresses in the panel. Support members 16 and 17 also serve as heat sinks for heat generated by discharges and thus minimize the effect of temperature on operation of the device. If it is desired that only the memory function be utilized, then none of the members need be transparent to light.

Except for being nonconductive or good insulators the electrical properties of support members 16 and 17 are not critical. The main function of support members 16 and 17 is to provide mechanical support and strength for the entire panel, particularly with respect to pressure differential acting on the panel and thermal shock. As noted earlier, they should have thermal expansion characteristics substantially matching the thermal expansion characteristics of dielectric layers 10 and 11. Ordinarly ¼ inch commercial grade soda lime plate glasses have been used for this purpose. Other glasses such as low expansion glasses or transparent devitrified glasses can be used provided they can withstand processing and have expansion characteristics substantially matching expansion characteristics of the dielectric coatings 10 and 11. For given pressure differentials and thickness of plates, the stress and deflection of plates may be determined by following standard stress and strain formulas (see R. J. Roark, *Formulas for Stress and Strain*, McGraw-Hill, 1954).

Spacer 15 may be made of the same glass material as dielectric films 10 and 11 and may be an integral rib formed on one of the dielectric members and fused to the other members to form a bakeable hermetic seal enclosing and confining the ionizable gas volume 12. However, a separate final hermetic seal may be effected by a high strength devitrified glass sealant 15S. Tubulation 18 is provided for exhausting the space between dielectric members 10 and 11 and filling that space with the volume of ionizable gas. For large panels small beadlike solder glass spacers such as shown at 15B may be located between conductor intersections and fused to dielectric members 10 and 11 to aid in withstanding stress on the panel and maintain uniformity of thickness of gas volume 12.

Conductor arrays 13 and 14 may be formed on support members 16 and 17 by a number of well-known processes, such as photoetching, vacuum deposition, stencil screening, etc. In the panel shown in FIG. 4, the center-to-center spacing of conductors in the respective arrays is about 17 mils. Transparent or semi-transparent conductive material such as tin oxide, gold, or aluminum can be used to form the conductor arrays and should have a resistance less than 3000 ohms per line. Narrow opaque electrodes may alternately be used so that discharge light passes around the edges of the electrodes to the viewer. It is important to select a conductor material that is not attacked during processing by the dielectric material.

It will be appreciated that conductor arrays 13 and 14 may be wires or filaments of copper, gold, silver or aluminum or any other conductive metal or material. For example 1 mil wire filaments are commercially available and may be used in the invention. However, formed in situ conductor arrays are preferred since they may be more easily and uniformly placed on and adhered to the support plates 16 and 17.

Dielectric layer members 10 and 11 are formed of an inorganic material and are preferably formed in situ as an adherent film or coating which is not chemically or physically affected during bake-out of the panel. One such material is a solder glass such as Kimble SG-68 manufactured by and commercially available from the assignee of the present invention.

This glass has thermal expansion characteristics substantially matching the thermal expansion characteristics of certain soda-lime glasses, and can be used as the dielectric layer when the support members 16 and 17 are soda-lime glass plates. Dielectric layers 10 and 11 must be smooth and have a dielectric breakdown voltage of about 1000 v. and be electrically homogeneous on a microscopic scale (e.g., no cracks, bubbles, cyrstals, dirt, surface films, etc.). In addition, the surfaces of dielectric layers 10 and 11 should be good photoemitters of electrons in a baked out condition. Alternately, dielectric layers 10 and 11 may be overcoated with materials designed to produce good electron emission, as in U.S. Pat. No. 3,634,719, issued to Roger E. Ernsthausen. Of course, for an optical display at least one of dielectric layers 10 and 11 should pass light generated on discharge and be transparent or translucent and, preferably, both layers are optically transparent.

The preferred spacing between surfaces of the dielectric films is about 4 to 8 mils with conductor arrays 13 and 14 having center-to-center spacing of about 17 mils.

The ends of conductors 14-1 . . . 14-4 and support member 17 extend beyond the enclosed gas volume 12 and are exposed for the purpose of making electrical connection to interface and addressing circuitry 19. Likewise, the ends of conductors 13-1 . . . 13-4 on support member 16 extend beyond the enclosed gas volume 12 and are exposed for the purpose of making electrical connection to interface and addressing circuitry 19.

As in known display systems, the interface and addressing circuitry or system 19 may be relatively inexpensive line scan systems or the somewhat more expensive high speed random access systems. In either case, it is to be noted that a lower amplitude of operating potentials helps to reduce problems associated with the interface circuitry between the addressing system and the display/memory panel, per se. Thus, by providing a panel having greater uniformity in the discharge characteristics throughout the panel, tolerances and operating characteristics of the panel with which the interfacing circuitry cooperate, are made less rigid.

One mode of initiating operation of the panel will be described with reference to FIG. 3, which illustrates the condition of one elemental gas volume 30 having an elemental cross-sectional area and volume which is quite small relative to the entire volume and cross-sectional area of gas 12. The cross-sectional area of volume 30 is defined by the overlapping common elemental areas of the conductor arrays and the volume is equal to the product of the distance between the dielectric surfaces and the elemental area. It is apparent that if the conductor arrays are uniform and linear and are orthogonally (at right angles to each other) related each of elemental areas X and Y will be squares and if conductors of one conductor array are wider than conductors of the other conductor arrays, said areas will be rectangles. If the conductor arrays are at transverse angles relative to each other, other than 90°, the areas will be diamond shaped so that the cross-sectional shape of each volume is determined solely in the first instance by the shape of the common area of overlap between conductors in the conductor arrays 13 and 14. The dotted lines 30' are imaginary lines to show a boundary of one elemental volume about the center of which each elemental discharge takes place. As described earlier herein, it is known that the cross-sectional area of the discharge in a gas is affected by, inter alia, the pressure of the gas, such that, if desired, the discharge may even be constricted to within an area smaller than the area of conductor overlap. By utilization of this phenomena, the light production may be confined or resolved substantially to the area of the elemental cross-sectional area defined by conductor overlap. Moreover, by operating at such pressure charges (ions and electrons) produced on discharge are laterally confined so as to not materially affect operation of adjacent elemental discharge volumes.

Figure 3:
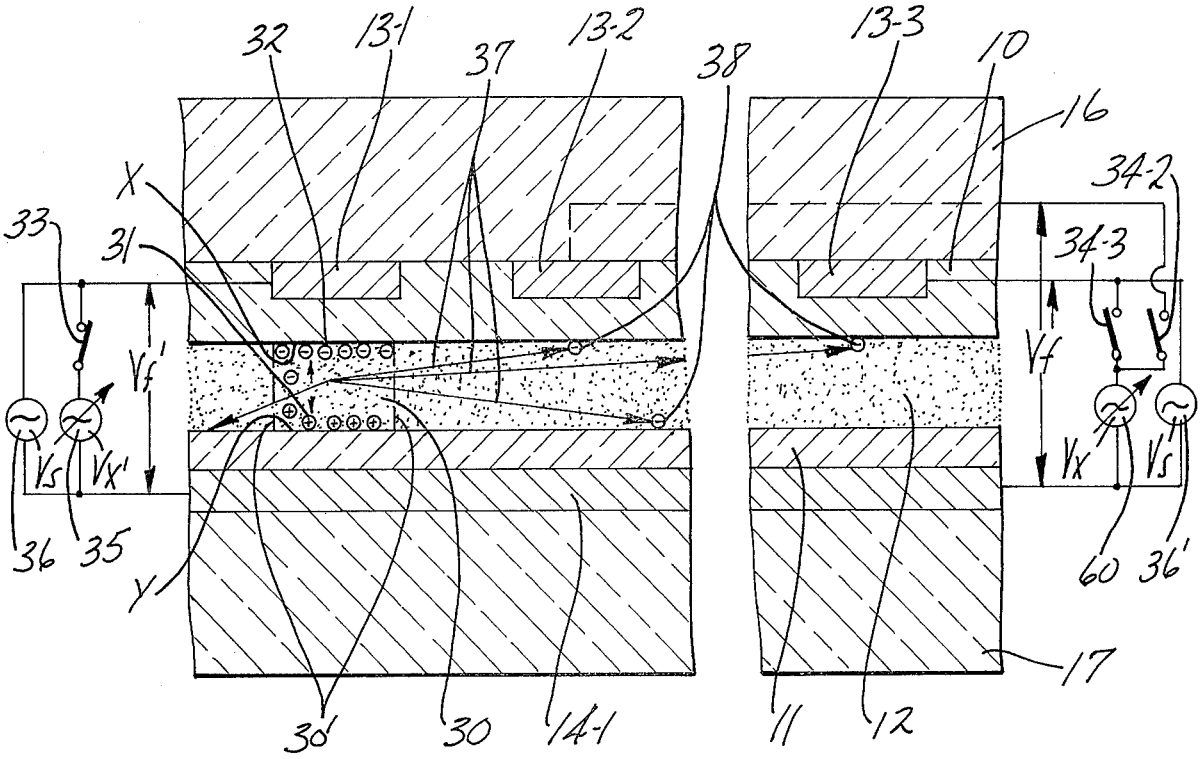
FIG. 3 is an explanatory partial cross-sectional view similar to FIG. 2 (enlarged, but not to proportional scale).

In the instant shown in FIG. 3, a conditioning discharge about the center of elemental volume 30 has been initiated by application to conductor 13-1 and conductor 14-1 firing potential $V_x'$ as derived from a source 35 of variable phase, for example, and source 36 of sustaining potential $V_s$ (which may be a sine wave, for example). The potential $V_x'$ is added to the sustaining potential $V_s$ as sustaining potential $V_s$ increases in magnitude to initiate the conditioning discharge about the center of elemental volume 30 shown in FIG. 3. There, the phase of the source 35 of potential $V_x'$ has been adjusted into adding relation to the alternating voltage from the source 36 of sustaining voltage $V_s$ to provide a voltage $V_f'$, when switch 33 has been closed, to conductors 13-1 and 14-1 defining elementary gas volume 30 sufficient (in time and/or magnitude) to produce a light generating discharge centered about discrete elemental gas volume 30. At the instant shown, since conductor 13-1 is positive, electrons 32 have collected on and are moving to an elemental area of dielectric member 10 substantially corresponding to the area of elemental gas volume 30 and the less mobile positive ions 31 are beginning to collect on the opposed elemental area of dielectric member 11 since it is negative. As these charges build up, they constitute a back voltage opposed to the voltage applied to conductors 13-1 and 14-1 and serve to terminate the discharge in elemental gas volume 30 for the remainder of a half cycle.

During the discharge about the center of elemental gas volume 30, photons are produced which are free to move or pass through gas medium 12, as indicated by arrows 37, to strike or impact remote surface areas of photoemissive dielectric members 10 and 11, causing such remote areas to release electrons 38. Electrons 38 are, in effect, free electrons in gas medium 12 and condition each other discrete elemental gas volume for operation at a lower firing potential $V_f$ which is lower in magnitude than the firing potential $V_f'$ for the initial discharge about the center of elemental volume 30 and this voltage is substantially uniform for each other elemental gas volume.

Thus, elimination of physical obstructions or barriers between discrete elemental volumes, permits photons to travel via the space occupied by the gas medium 12 to impact remote surface areas of dielectric members 10 and 11 and provides a mechanism for supplying free electrons to all elemental gas volumes, thereby conditioning all discrete elemental gas volumes for subsequent discharges, respectively, at a uniform lower applied potential. While in FIG. 3 a single elemental volume 30 is shown, it will be appreciated that an entire row (or column) of elemental gas volumes may be maintained in a "fired" condition during normal operation of the device with the light produced thereby being masked or blocked off from the normal viewing area and not used for display purposes. It can be expected that in some applications there will always be at least one elemental volume in a fired condition and producing light in a panel, and in such applications it is not necessary to provide separate discharge or generation of photons for purposes described earlier.

However, as described earlier, the entire gas volume can be conditioned for operation at uniform firing potentials by use of external or internal radiation so that there will be no need for a separate source of higher potential for initiating an initial discharge. Thus, by radiating the panel with ultraviolet radiation or by inclusion of a radioactive material within the glass materials of gas space, all discharge volumes can be operated at uniform potentials from addressing and interface circuit 19.

Since each discharge is terminated upon a build up or storage of charges at opposed pairs of elemental areas, the light produced is likewise terminated. In fact, light production lasts for only a small fraction of a half cycle of applied alternating potential and depending on design parameters, is in the nanosecond range.

After the initial firing or discharge of discrete elemental gas volume 30 by firing potential $V_f'$, switch 33 may be opened so that only the sustaining voltage $V_s$ from source 36 is applied to conductors 13-1 and 14-1. Due to the storage of charges (e.g., the memory) at the opposed elemental areas X and Y, the elemental gas volume 30 will discharge again at or near the peak of negative half cycles of sustaining voltage $V_s$ to again produce a momentary pulse of light. At this time, due to reversal of field direction, electrons 32 will collect on and be stored on elemental surface area Y of dielectric member 11 and positive ions 31 will collect and be stored on elemental surface area X of dielectric member 10. After a few cycles of sustaining voltage $V_s$, the times of discharges becomes symmetrically located with respect to the wave form of sustaining voltage $V_s$. At remote elemental volumes, as for example, the elemental volumes defined by conductor 14-1 with conductors 13-2 and 13-3, a uniform magnitude or potential $V_x$ from source 60 is selectively added by one or both of switches 34-2 or 34-3 to the sustaining voltage $V_s$, shown as 36', to fire one or both of these elemental discharge volumes. Due to the presence of free electrons produced as a result of the discharge centered about elemental volume 30, each of these remote discrete elemental volumes have been conditioned for operation at uniform firing potential $V_f$.

In order to turn "off" an elemental gas volume (i.e., terminate a sequence of discharge representing the "on" state), the sustaining voltage may be removed. However, since this would also turn off other elemental volumes along a row or column, it is preferred that the volumes be selectively turned off by application to selected on elemental volumes a voltage which can neutralize the charges stored at the pairs of opposed elemental areas.

This can be accomplished in a number of ways, as for example, varying the phase or time position of the potential from source 60 to where that voltage combined with the potential from source 36' falls substantially below the sustaining voltage.

It is apparent that the plates 16-17 need not be flat but may be curved, curvature of facing surfaces of each plate being complementary to each other. While the preferred conductor arrangement is of the crossed grid type as shown herein, it is likewise apparent that where an infinite variety of two dimensional display patterns are not necessary, as where specific standardized visual shapes (e.g., numerals, letters, words, etc.) are to be formed and image resolution is not critical, the conductors may be shaped accordingly. Reference is made to British patent specification No. 1,302,148 and U.S. Pat. No. 3,711,733 wherein non-grid electrode arrangements are illustrated.

Figure 4:
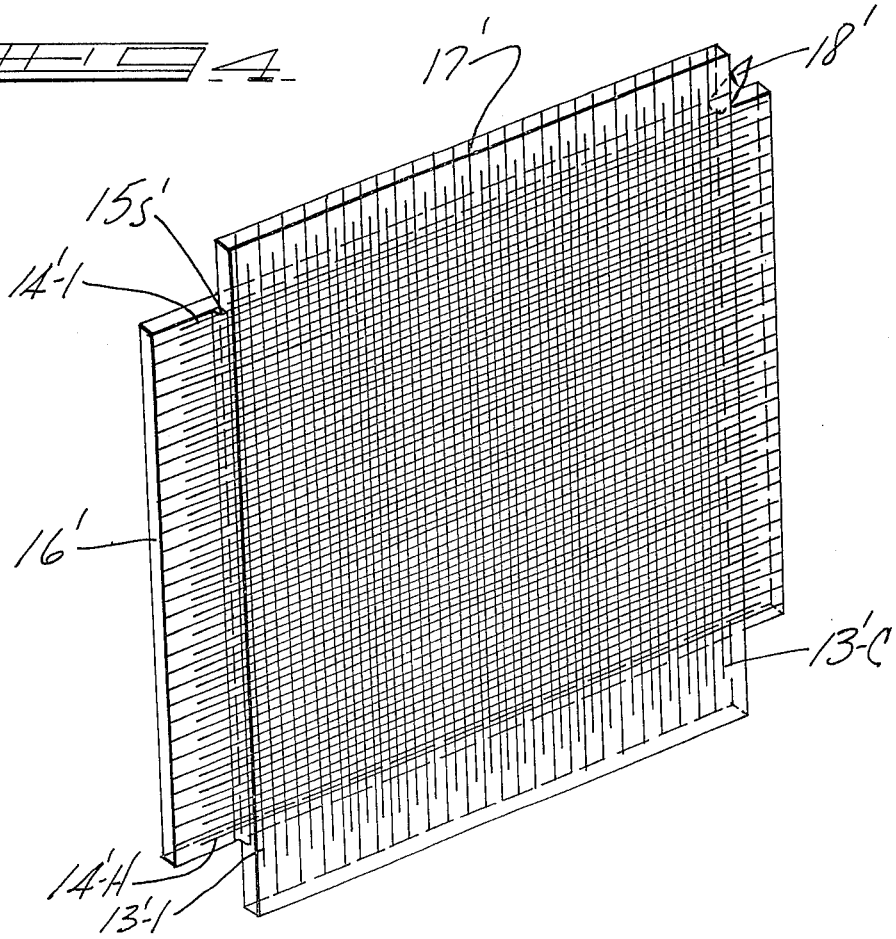
FIG. 4 is an isometric view of a gaseous discharge display/memory panel.

The device shown in FIG. 4 is a panel having a large number of elemental volumes similar to elemental volume 30 (FIG. 3). In this case more room is provided to make electrical connection to the conductor arrays 13' and 14', respectively, by extending the surfaces of support members 16' and 17' beyond seal 15S', alternate conductors being extended on alternate sides. Conductor arrays 13' and 14' as well as support members 16' and 17' are transparent. The dielectric coatings are not shown in FIG. 4 but are likewise transparent so that the panel may be viewed from either side.

THE INVENTION

In accordance with this invention, the surface of each dielectric material charge storage member is provided with a first layer of at least one compound of Group IIA, Al, Si, Ti, Zr, Hf, or mixtures thereof; a second layer of at least one compound of Group IIA, Al, Si, Ti, Zr, Hf, or mixtures thereof which is chemically different from the first layer; and a third layer of electron-emissive material; the combination of the first and second layers being sufficient to prevent ion migration from the dielectric to the third layer and sufficient to provide a thermally and structurally stable base for the third layer; and the second layer being chemically inert relative to the third layer.

Typical compounds contemplated for the first and second layers include the oxides, nitrides, fluorides, borides, and carbides of the Group IIA elements, Al, Si, Ti, Zr, Hf, or mixtures thereof. By mixtures thereof, it is intended that a given layer may comprise a mixture of two or more compounds (of the same or different element) and/or may comprise a single compound containing two or more elements.

The combination of the first and second layers should provide a thermally and structurally stable base for the top layer; that is, the first two layers must be such that there is a minimum formation of cracks, fissures, flaws, crazes, crevices, etc., especially during the thermal sealing of the panel.

As used herein Group IIA is defined as including the elements Be, Mg, Ca, Sr, and Ba. Likewise, Ra is intended although economics may prohibit common usage.

The three layers are preferably non-conductive. However, conductive materials may be utilized if such are applied in island-like geometric patterns (e.g., at each cell site) so as to be structurally and electrically isolated from the electrodes and/or gaseous medium.

As used herein, electron-emissive refers to the processes of photoemission, secondary electron emission of ion and/or electron bombardment, and thermionic electron emission.

Typical conductive or semi-conductive materials which may be utilized, such as in an isolated geometric arrangement, comprises GaAs, GaP, InAs, InSb, InP, NiO, AgOCs, and AuOCs.

Preferably there is used a non-conductive substance such as CsF, CsT, lead oxide, and/or magnesium oxide.

In a specific embodiment of this invention, each dielectric surface is provided with a first layer of silica, a second layer of aluminum oxide, and a third layer of lead oxide.

In another specific embodiment, there is utilized a first layer of silica, a second layer of zirconium oxide, and a third layer of lead oxide.

A further specific embodiment comprises a first layer of magnesium oxide, a second layer of zirconium oxide, and a third layer of lead oxide.

Still another specific embodiment comprises a first layer of $Si_3N_4$, a second layer of silica, and a third layer of lead oxide.

Another embodiment comprises a first layer of magnesium oxide, a second layer of aluminum oxide, and a third layer of lead oxide.

Another embodiment comprises a first layer of silica, a second layer of aluminum oxide, and a third layer of magnesium oxide.

Another embodiment comprises a first layer of silica, a second layer of zirconium oxide, and a third layer of magnesium oxide.

Another embodiment comprises a first layer of magnesium oxide, a second layer of zirconium oxide, and a third layer of magnesium oxide.

Another embodiment comprises a first layer of $Si_3N_4$, a second layer of silica, and a third layer of magnesium oxide.

Another embodiment comprises a first layer of magnesium oxide, a second layer of aluminum oxide and a third layer of magnesium oxide.

Each of the three layers is applied to the dielectric surface (or previously applied layer) by any convenient means including not by way of limitation vapor deposition; vacuum deposition; chemical vapor deposition; wet spraying upon the surface a mixture or solution of the layer substance suspended or dissolved in a liquid followed by evaporation of the liquid; dry spraying of the layer upon the surface; electron beam evaporation; plasma flame and/or arc spraying and/or deposition; and sputtering target techniques.

In the typical practice hereof, the first two layers are oxides.

In one embodiment of such practice, one or both oxide layers is applied directly to the surface of the dielectric material or preceding layer, via the aforementioned processes.

In another embodiment thereof, at least one of the oxide layers is formed in situ on the dielectric surface, e.g., by applying the elemental metal or metalloid (or a source thereof) to the dielectric surface followed by oxidation. One such in situ process comprises applying metal or metalloid melt to the dielectric followed by oxidation of the melt during the cooling thereof so as to form the oxide layer. Another in situ process comprises applying an oxidizable source of the elemental metal or metalloid to the surface. Typical of such oxidizable sources include minerals and/or compounds containing the metal or metalloid, especially those organometals or organometalloids which are readily heat decomposed or pyrolyzed. In the usual practice hereof, each of the three layers is applied to or formed on the dielectric material surface to a thickness of at least about 100 angstrom units per layer with a range of about 200 angstrom units per layer up to about 1 micron (10,000 angstrom units) per layer.

As used herein, the terms "film" or "layer" are intended to be all inclusive of other similar terms such as deposit, coating, finish, spread, covering, etc.

In the fabrication of a gaseous discharge panel, the dielectric material is typically applied to and cured on the surface of a supporting glass substrate or base to which the electrode or conductor elements have been previously applied. The glass substrate may be of any suitable composition such as a soda lime glass composition. Two glass substrates containing electrodes and cured dielectric are then appropriately heat sealed together so as to form a panel.

In the preferred practice of this invention, each of the three layers is applied to the surface of the cured dielectric before the panel heat sealing cycle, with the substrate at a temperature of about 150°F to about 600°F.

Gaseous discharge display/memory panels prepared in accordance with the practice of this invention have the advantage of decreased aging cycle time, lower operating voltages, and substantially uniform operation voltages; that is, operating voltages which are essentially stable as a function of total panel operating time. As used herein, voltage is defined as any voltage required for operation of the panel including firing and dynamic sustaining voltages as well as any other voltages used for manipulation of a cell discharge.

Also this invention has the further important advantage of providing a gas discharge device dielectric surface which will consistently remain continuous and coherent through the thermal cycling required in the panel sealing operation; that is, there results a sufficiently stress-balanced three coating composite which avoids film cracking and crazing. Prior art thin films deposited at the dielectric discharge surface possess a marked tendency to craze when subjected to conventional sealing cycles. The advantage of using an essentially stress-balanced composite of films is that it permits conventional sealing with commercial solder glasses. Another advantage is that the stress-balanced composite is much less sensitive to substrate imperfections and to substrate temperature during deposition.

The following examples are intended to illustrate some of the best embodiments contemplated by the inventor in the practice of this invention.

EXAMPLE I

Using a ¼ inch thick soda-lime silicate base glass substrate containing gold conductors and bulk glass dielectric of about 1 mil thickness, a composite of coatings is sequentially deposited by vacuum deposition techniques using electrom beam evaporation. On the bulk glass dielectric, about 700A of magnesium oxide is first deposited followed by a second layer of about 1000A of alumina. Onto this a third layer of about 1000A of lead oxide is deposited to form the discharge-memory surface. Subsequent sealing of substrates coated in this way with commercial solder glasses repeatedly demonstrates the thermal stability of three layer composite.

EXAMPLE II

The procedure of EXAMPLE I is repeated using the thicknesses and oxides summarized in the TABLE I hereinafter. All of the thicknesses are in angstrom units.

TABLE I

| COMBINATION | 1st LAYER | 2nd LAYER | 3rd LAYER |
|---|---|---|---|
| A | 550 magnesium oxide | 850 aluminum oxide | 1000 lead oxide |
| B | 550 magnesium oxide | 1150 aluminum oxide | 1000 lead oxide |
| C | 850 magnesium oxide | 850 aluminum oxide | 1000 lead oxide |

TABLE I-continued

| COMBINATION | 1st LAYER | 2nd LAYER | 3rd LAYER |
|---|---|---|---|
| D | 850 magnesium oxide | 1150 aluminum oxide | 1000 lead oxide |

Subsequent sealing of substrates coated with each combination demonstrates the thermal stability of each three layer composite.

Figure 5:
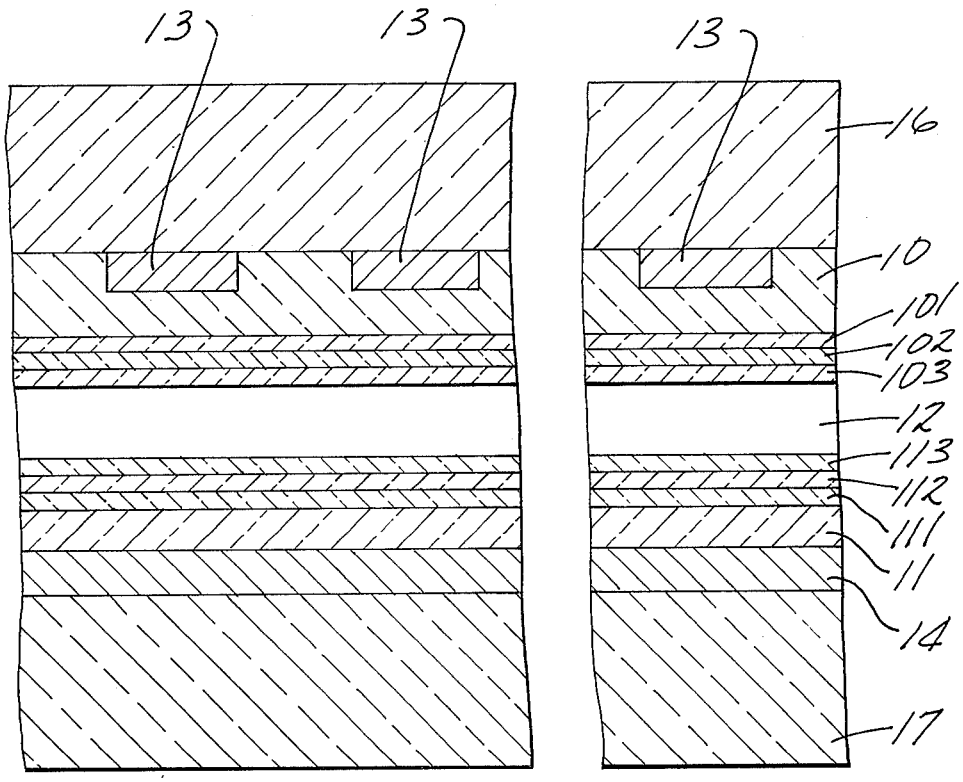

FIG. 5 illustrates one practice of this invention utilizing a cross-sectional view as in FIG. 4.

In FIG. 5 there is shown substrates 16, 17, electrodes 13, 14, gaseous medium 12, dielectric members 10, 11, first dielectric overcoats or layers 101,111, second dielectric layers 102, 112, and third dielectric layers 103, 113. In EXAMPLE II, TABLE I, the first layer is 550 angstrom units of magnesium oxide, the second layer is 850 angstrom units of aluminum oxide, and the third layer is 1000 angstrom units of lead oxide.

I claim:

1. As an article of manufacture, a dielectric material body for gaseous discharge panel, said body having thereon a first layer of at least one compound of Group IIA, Al, Si, Ti, Zr, Hf, or mixtures thereof; a second layer of at least one compound of Group IIA, Al, Si, Ti, Zr, Hf, or mixtures thereof which is chemically different from the first layer; and a third layer of an electron-emissive material; the combination of the first and second layers being sufficient to prevent ion migration from the dielectric to the third layer and sufficient to provide a thermally and structurally stable base for the third layer; and the second layer being chemically inert relative to the third layer.

2. The invention of claim 9 wherein the first layer is magnesium oxide, the second layer is alumina, and the third layer is lead oxide.

3. In a gaseous discharge panel comprising an ionizable gaseous medium in a gas chamber formed by a pair of opposed dielectric material charge storage surfaces backed by electrode members, the electrode members behind each dielectric material surface being oriented relative to the electrode material members behind the opposing dielectric material surface so as to define a plurality of discharge units, the improvement wherein each dielectric surface is coated with a first layer of at least one compound of Group IIA, Al, Si, Ti, Zr, Hf, or mixtures thereof; a second layer of at least one compound of Group IIA, Al, Si, Ti, Zr, Hf, or mixtures thereof which is chemically different from the first layer; and a third layer of an electron-emissive material; the combination of the first and second layers being sufficient to prevent ion migration from the dielectric to the third layer and sufficient to provide a thermally and structurally stable base for the third layer; and the second layer being chemically inert relative to the third layer.

4. The invention of claim 3 wherein the compounds of the first and second layers are selected from oxides and the third layer compound is selected from lead oxide or magnesium oxide.

5. In a gaseous discharge panel characterized by an ionizable gaseous medium in a gas chamber formed by a pair of opposed dielectric material charge storage surfaces, the improvement wherein each dielectric surface is coated with a first layer of at least one compound of Group IIA, Al, Si, Ti, Zr, Hf, or mixtures thereof; a second layer of at least one compound of Group IIA, Al, Si, Ti, Zr, Hf, or mixtures thereof which is chemically different from the first layer; and a third layer of an electron-emissive material; the combination of the first and second layers being sufficient to prevent ion migration from the dielectric to the third layer and sufficient to provide a thermally and structurally stable base for the third layer; and and second layer being chemically inert relative to the third layer.

6. The invention of claim 1 wherein the thickness of each layer ranges from about 200 angstrom units to about 10,000 angstrom units.

7. The invention of claim 1 wherein the thickness of each layer is at least about 100 angstrom units.

8. The invention of claim 7 wherein the compounds of the first and second layers are selected from oxides.

9. The invention of claim 8 wherein the third layer is electrically non-conductive.

10. The invention of claim 9 wherein the third layer is selected from the group consisting of lead oxide and magnesium oxide.

11. In the operation of a gaseous discharge panel characterized by an ionizable gaseous medium in a gas chamber formed by a pair of dielectric material members having opposed charge storage surfaces, which dielectric material members are respectively backed by an array of electrode members, the electrode members behind each dielectric material member being oriented with respect to the electrode members behind the opposing dielectric material member so as to define a plurality of discrete discharge volumes constituting a discharge unit, and wherein the gas is selectively ionized within each discharge unit by operating voltage applied to the transversely oriented electrode members, the improvement which comprises decreasing and stabilizing the equal operating voltages over a given period of panel operating time and increasing the effective panel operating life by coating each opposed dielectric material charge storage surface with a first layer of at least one compound of Group IIA, Al, Si, Ti, Zr, Hf, or mixtures thereof; a second layer of at least one compound of Group IIA, Al, Si, Ti, Zr, Hf, or mixtures thereof which is chemically different from the first layer; and a third layer of an electron-emissive material; the combination of the first and second layers being sufficient to prevent ion migration from the dielectric to the third layer and sufficient to provide a thermally and structurally stable base for the third layer; and the second layer being chemically inert relative to the third layer.

12. The invention of claim 11 wherein the compounds of the first two layers are selected from oxides and the third layer is selected from magnesium oxide and lead oxide.

* * * * *